US007172311B2

(12) United States Patent
Ross

(10) Patent No.: US 7,172,311 B2
(45) Date of Patent: Feb. 6, 2007

(54) FLASHLIGHT DEVICES AND ACCESSORIES

(75) Inventor: Jeremy B. Ross, Savoy, IL (US)

(73) Assignee: First-Light USA, LLC, Seymour, IL (US)

( * ) Notice: Subject to any disclaimer, the term of this patent is extended or adjusted under 35 U.S.C. 154(b) by 0 days.

(21) Appl. No.: 10/775,943

(22) Filed: Feb. 10, 2004

(65) Prior Publication Data

US 2004/0228120 A1 Nov. 18, 2004

Related U.S. Application Data

(60) Provisional application No. 60/446,183, filed on Feb. 10, 2003.

(51) Int. Cl.
*F21L 4/04* (2006.01)

(52) U.S. Cl. ..... 362/199; 362/110; 362/399

(58) Field of Classification Search ..... 362/197, 362/199, 190, 191, 399, 202, 110, 111
See application file for complete search history.

(56) References Cited

U.S. PATENT DOCUMENTS

| | | | | | |
|---|---|---|---|---|---|
| 1,119,663 | A | * | 12/1914 | Swallow | 362/199 |
| 1,267,436 | A | | 5/1918 | Martin | |
| 1,307,456 | A | | 6/1919 | Prahar | |
| 1,527,792 | A | | 2/1925 | French | |
| 1,599,499 | A | | 9/1926 | St. John | |
| 1,763,815 | A | * | 6/1930 | Pajeau | 362/197 |
| 1,893,108 | A | * | 1/1933 | Shannon | 362/199 |
| 1,906,193 | A | | 4/1933 | Vitale | |
| 1,986,281 | A | * | 1/1935 | Nygard | 362/197 |
| 2,132,063 | A | | 10/1938 | Whaley | |
| 2,265,610 | A | | 12/1941 | Morgan | |
| 2,356,396 | A | | 8/1944 | Gonseor | |
| 2,450,584 | A | | 10/1948 | Dodge | |
| 2,588,036 | A | * | 3/1952 | O'Quinn | 446/407 |
| 2,629,045 | A | | 2/1953 | Frohlich | |
| 3,112,889 | A | | 12/1963 | Marmo et al. | |
| 3,354,570 | A | * | 11/1967 | Rizzo, Jr. | 42/146 |
| 3,628,005 | A | * | 12/1971 | Rhoades | 362/191 |
| 3,970,228 | A | * | 7/1976 | Keller | 224/251 |
| 4,345,304 | A | * | 8/1982 | Penney et al. | 362/183 |
| 4,348,716 | A | | 9/1982 | Storm et al. | |
| 4,425,600 | A | | 1/1984 | Barnhart | |
| 4,447,863 | A | | 5/1984 | Fenne | |

(Continued)

FOREIGN PATENT DOCUMENTS

| | | |
|---|---|---|
| EP | 04 84891 | 5/1992 |

(Continued)

*Primary Examiner*—Renee Luebke
*Assistant Examiner*—Gunyoung T. Lee
(74) *Attorney, Agent, or Firm*—Douglas W. Rommelmann; Andrews Kurth LLP

(57) ABSTRACT

Disclosed is a preferred flashlight device configured for potential use with another item such as a firearm or in activities where some manual dexterity of the hand grasping the flashlight is required. Preferred devices include downwardly-extending light and handle portions, interconnected by a transverse member. Preferred devices include moveable connections between the light and handle members and the transverse member, so that the direction of a beam emanating from the flashlight can be optimized to an activity undertaken while holding the flashlight, for example during a two-handed pistol firing position.

18 Claims, 15 Drawing Sheets

U.S. PATENT DOCUMENTS 4,459,646 A 7/1984 Drane
4,533,982 A 8/1985 Kozar
4,542,447 A 9/1985 Quakenbush
4,977,489 A 12/1990 Fung
4,999,750 A 3/1991 Gammache
5,019,951 A * 5/1991 Osterhout et al. ..... 362/191
5,040,322 A 8/1991 Itarrey, Jr.
5,064,988 A 11/1991 E'nama et al.
5,086,377 A * 2/1992 Roberts ..... 362/102
5,097,399 A 3/1992 Gammache
5,161,095 A 11/1992 Gammache
5,167,446 A 12/1992 Haroutunian
5,190,369 A 3/1993 Pace
5,265,781 A * 11/1993 Nichols ..... 224/198
5,278,739 A 1/1994 Gammache
5,345,368 A 9/1994 Huff
5,363,285 A 11/1994 Wideman
5,410,457 A * 4/1995 Parker ..... 362/205
5,429,119 A * 7/1995 Griffin et al. ..... 600/200
5,448,458 A 9/1995 Smyly, Jr.
5,522,167 A 6/1996 Teetzel
5,530,633 A 6/1996 Yuen
5,533,657 A 7/1996 Rosen et al.
5,541,822 A 7/1996 Bamber
5,556,003 A 9/1996 Johnson et al.
5,558,430 A * 9/1996 Booty, Jr. ..... 362/184
5,570,948 A 11/1996 Menke et al.
5,580,157 A 12/1996 Patricca et al.
5,593,074 A 1/1997 Matthews
5,628,555 A 5/1997 Sharrah et al.
5,632,548 A 5/1997 Mayfarth
5,642,932 A 7/1997 Matthews
5,685,105 A 11/1997 Teetzel
5,720,543 A 2/1998 Sheps
5,743,623 A 4/1998 Kerr
5,752,633 A 5/1998 Antaki
5,848,834 A 12/1998 Kerr
5,859,582 A * 1/1999 Yuen ..... 340/326
5,871,272 A 2/1999 Sharrah et al.
5,993,022 A 11/1999 Neyer et al.
6,012,824 A 1/2000 Sharrah et al.
6,023,875 A 2/2000 Fell et al.
6,213,619 B1 * 4/2001 Yu ..... 362/103
6,220,720 B1 4/2001 Stephens
6,270,231 B1 8/2001 Kerr
6,315,426 B1 11/2001 Buller
6,322,233 B1 * 11/2001 Brandt ..... 362/199
6,523,972 B2 2/2003 Sharrah et al.
6,550,930 B1 4/2003 Portouche
6,612,714 B1 9/2003 Morre et al.
6,641,277 B2 * 11/2003 Smith ..... 362/111
6,644,827 B2 11/2003 Birdwell
6,659,621 B2 12/2003 Sharrah et al.
6,761,467 B2 7/2004 Matthews et al.
6,817,730 B2 11/2004 Sharrah et al.
6,916,104 B2 7/2005 Parsons et al.
2001/0048596 A1 12/2001 Kerr
2002/0172034 A1 11/2002 Lawless
2003/0058636 A1 3/2003 Smith
2004/0012954 A1 1/2004 Hart
2004/0032750 A1 2/2004 Watts et al.
2004/0052073 A1 3/2004 Chang et al.
2004/0114373 A1 6/2004 Lin
2004/0198336 A1 10/2004 Jancic et al.
2004/0255361 A1 12/2004 Senter et al.

FOREIGN PATENT DOCUMENTS

EP 0721082 7/1996
GB 272758 6/1927

* cited by examiner

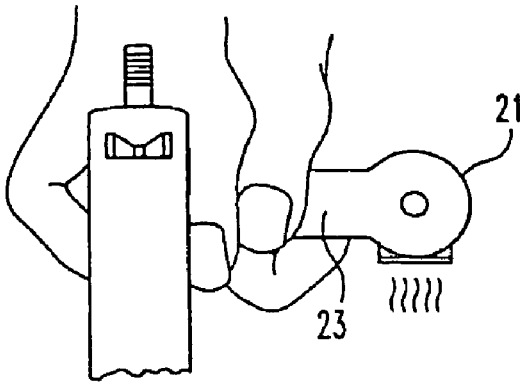
Fig. 6
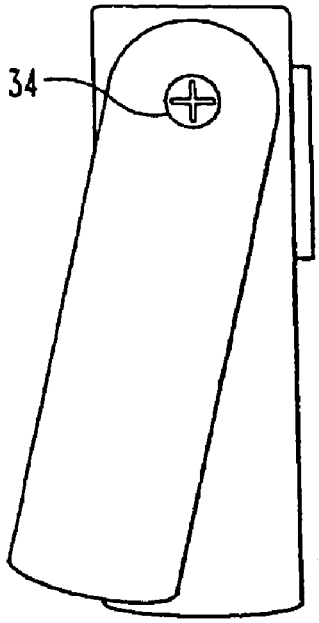
Fig. 7
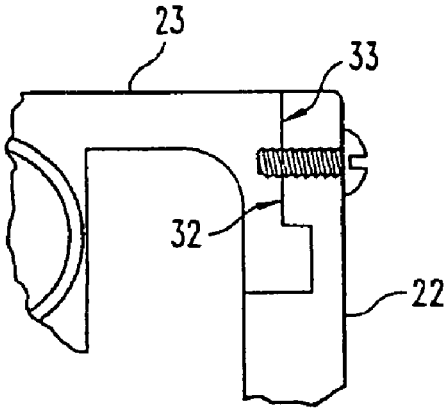
Fig. 8
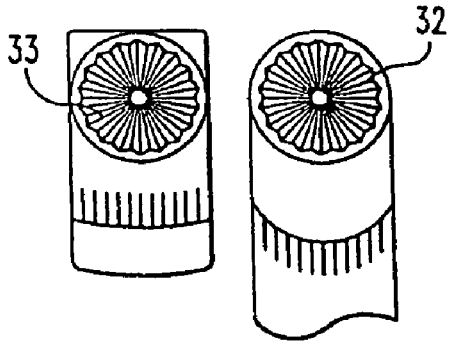
Fig. 9A
Fig. 9B

FLASHLIGHT DEVICES AND ACCESSORIES

REFERENCE TO RELATED APPLICATION

This application claims priority to U.S. Provisional Patent Application Ser. No. 60/446,183 filed Feb. 10, 2003, which is hereby incorporated by reference in its entirety.

BACKGROUND

The present invention relates generally to flashlights, and in particular to a flashlight adapted for convenient use in conjunction with other hand-held implements, such as firearms, or in conjunction with activities requiring the use of one's hands.

By way of background, a number of flashlights or flashlight holders are known that are designed for use in combat or self-defense situations. Several of these holders and flashlights are disclosed, for example, in U.S. Pat. Nos. 6,270,231, 5,848,834, 5,167,446, 4,542,447, 5,642,932, 5,363,285, 5,556,003, 5,345,368, 6,023,875, 5,752,633, 5,533,657, and 5,593,074. An additional such flashlight device is disclosed in EP0484891.

In spite of prior work in the area, there remain needs for improved flashlight devices for potential use in conjunction with other hand-held implements such as firearms, particularly in self-defense and/or combat situations, or when performing other tasks or activities that require two handed operation such as those that commonly occur in industrial environments or outdoor activities. The present invention is directed to these needs.

SUMMARY OF THE INVENTION

One aspect of the present invention provides a flashlight adapted for use in conjunction with a firearm, especially a handgun, having adaptations for optimally positioning the light during use. In one embodiment of the present invention, a flashlight device is provided having a downwardly-extending lightbox, a downwardly-extending handle portion, and a transverse member connecting the lightbox and the handle portion. Illustratively, the handle portion and lightbox may depend from a generally horizontally extending transverse member, to provide a flashlight form convenient for handling during a two-handed firearm firing position, other two-handed operations, or in general other activities which benefit from manual dexterity of the hand grasping the flashlight. In more preferred embodiments, the device is configured so the positions of the lightbox and handle portion are moveable relative to one another to optimize adjustments for the user. For example, the lightbox and handle portion may be re-positionable relative to one another in vertical and/or horizontal planes. In a most preferred form, the invention provides a flashlight device wherein the lightbox and handle portion are both vertically and horizontally adjustable relative to one another so that a user can position the beam lower or higher, or to the left or the right, to provide an optimal direction for a light beam emanating from the lightbox, for example during a normal two-handed firing position of a pistol. The vertical and horizontal adjustments are desirably located on different portions of the flashlight device. For example, the lightbox may be rotatable in a horizontal plane relative to the transverse member to which it is attached; and the handle portion can be rotatable in a vertical plane relative to the transverse member to which it is attached.

Additional preferred embodiments as well as features and advantages of the invention will be apparent from the following descriptions.

BRIEF DESCRIPTION OF THE DRAWINGS

FIG. 6 provides a top view of a flashlight device of the invention in use during a two-handed firing position.

FIG. 7 provides a side view of a flashlight device of the invention illustrating an offset angle between a handle portion and a lightbox of the device.

FIG. 8 provides a cutaway view of a rotatable and lockable connection between a handle portion and a transverse member of a flashlight device of the invention.

FIGS. 9A and 9B are views of cooperating surface features on the transverse member and handle portion, respectively, shown in FIG. 8, providing a rotatable/locking mechanism using meshable locking plates.

DESCRIPTION OF THE PREFERRED EMBODIMENTS

For the purpose of promoting an understanding of the principles of the invention, reference will now be made to certain preferred embodiments thereof and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

Figure 1:
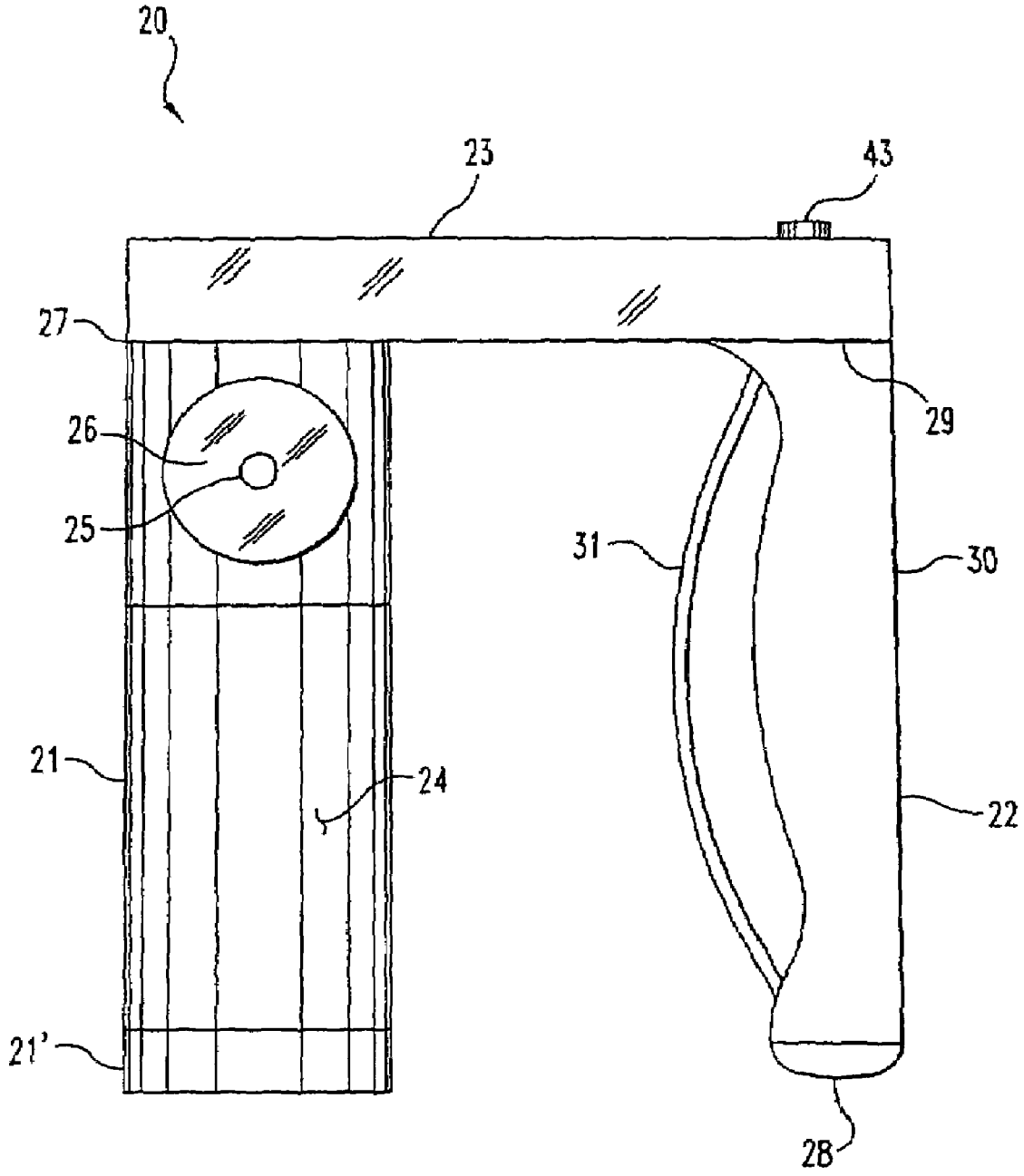
FIG. 1 provides a side view of a flashlight device of the invention.

As disclosed above, the present invention provides flashlight devices and apparatuses suited for use in two-handed grasping operations or other operations where manual dexterity of the hand holding the flashlight is beneficial, for example in self-defense and/or combat situations, in industrial environments and/or in outdoor recreation. With reference now to FIG. 1, shown is a plan view of one preferred flashlight device 20 of the present invention. Flashlight device 20 includes a generally downwardly-extending lightbox 21, a generally downwardly-extending handle portion 22, and a transverse member 23 connecting the lightbox 21 and handle portion 22. Lightbox 21 includes a generally cylindrical body 24 having mounted therein a light source 25 situated behind a lens 26, preferably formed with a relatively shatter-proof plastic material such as Lexmar. Light source 25 is energizeable by one or more batteries residing within the lightbox 21 as will be discussed herein below. The light source 25 will preferably be capable of delivering at least about 20,000 candle power (CP), typically in the range of about 20,000 to about 50,000 CP. Higher or lower intensities may also be desirable for particular utilities for the flashlight. The light source 25 may, for example, include a halogen, xenon or other pressurized gas bulb, or one or a plurality of light emitting diodes (LEDs); in one embodiment of the invention, the light source 25 includes a plurality of LEDs, for example 2, 3, 4, 5 or 6 or more LEDs.

Lightbox 21 is connected to transverse member 23 at its upper end 27. Although this connection could be integral, it is preferred that the connection be a moveable connection, for example providing for rotation within a horizontal plane so that a user of the flashlight can adjust the direction of the light beam emanating from the light source 25 in a horizontal fashion.

Figure 3:
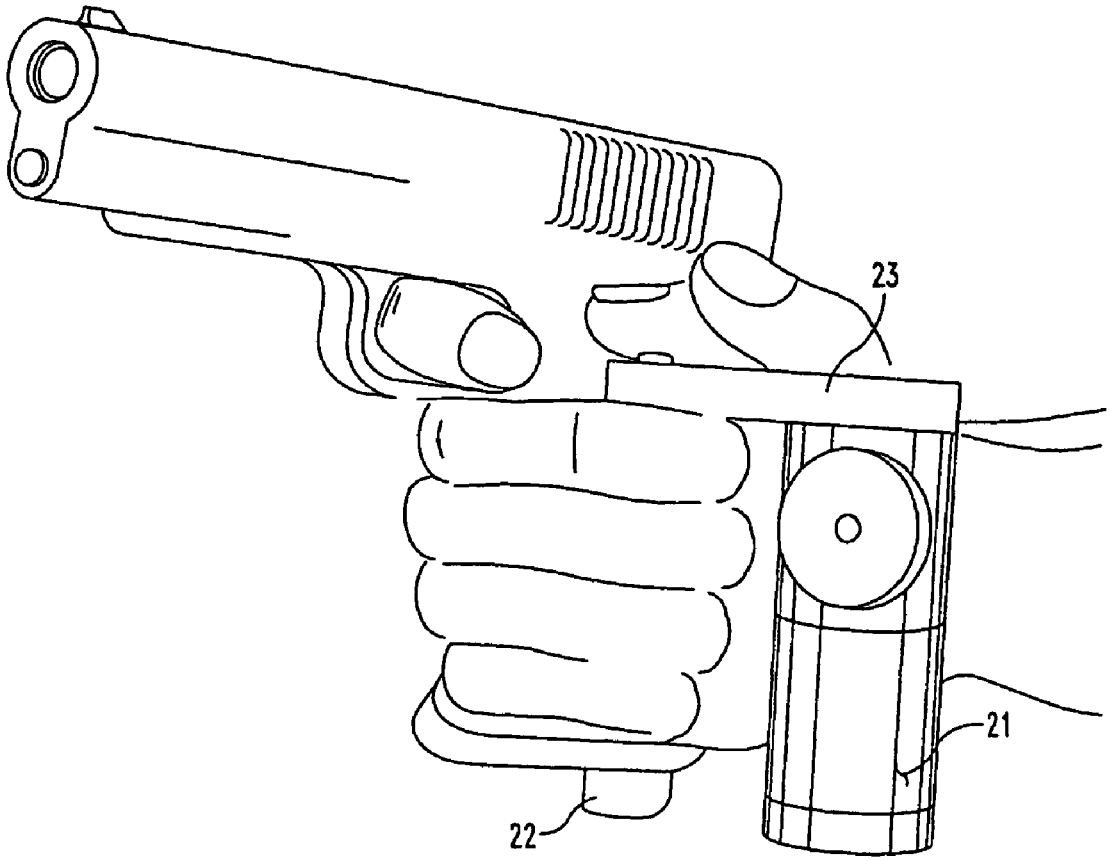
FIG. 3 provides a perspective view of a flashlight device of the invention in use during a two-handed firing position.

Handle portion 22 includes a lower end 28 and an upper end 29, and a central portion 30 spanning between the lower end 28 and upper end 29. Central portion 30 can if desired have external adaptations to improved the ergonomic character of the handle portion 22. For example, central portion 30 may include one or more convex or concave sections. In one embodiment, as illustrated in FIG. 1, central portion 30 includes an inwardly-facing (toward the lightbox 21) convex portion 31 adapted to ergonomically cooperate with the palm of the hand in a firing position (see e.g. FIG. 3). As also shown in FIG. 1, handle portion 22 can incorporate a strap extending inwardly from handle portion 22 and through which the user's hand can be placed while holding the flashlight 20. As shown in FIG. 3, in the firing position, the handle portion 22 is grasped in a hand of the user, the transverse portion 23 extends overtop the hand, and the lightbox 21 extends down the back side of the hand. If desired, handle portion 22 can be covered with or made of a material with a relatively high coefficient of friction compared to other portions of the flashlight to improve gripping properties. For example, handle portion 22 may be covered with a polymeric sleeve, including, e.g. an elastomeric sleeve such as a neoprene sleeve.

Handle portion 22 is connected at its upper end 29 to transverse member 23. Although this connection may be integral, it is preferred that this connection provide for movement of the two elements relative to one another. For example, in one preferred embodiment the handle portion is rotatable in a generally vertical plane relative to the transverse member 23. In doing so, it is also preferred that the rotated position be lockable between the handle portion 22 and transverse member 23. This locking or fixing of the positions may be facilitated, for example, by appropriate detent devices or for example by providing a first surface 32 of or connected to the handle portion 22, which cooperates with a second similar surface 33 connected to the transverse member 23 (See e.g. FIGS. 8 and 9). The two surfaces 32 and 33 have cooperating ridges, teeth or other interlocking members. While a connector such as a screw 34 (see FIG. 7) is positioned to allow separation between the plates, the handle portion 22 and transverse member 23 can be rotated relative to one another. Thereafter, when rotated to the desired degree, the connector 34 is utilized to fix the two plates against one another so as to cause the interlocking members on the plates to mesh, and fix the position of the handle portion 22 and transverse member 23 relative to one another. In this fashion, a user of the device 20 can adjust the vertical orientation of the light beam to optimize its direction during a normal two-handed firing position with a handgun (see e.g. FIG. 7).

Figure 2A:
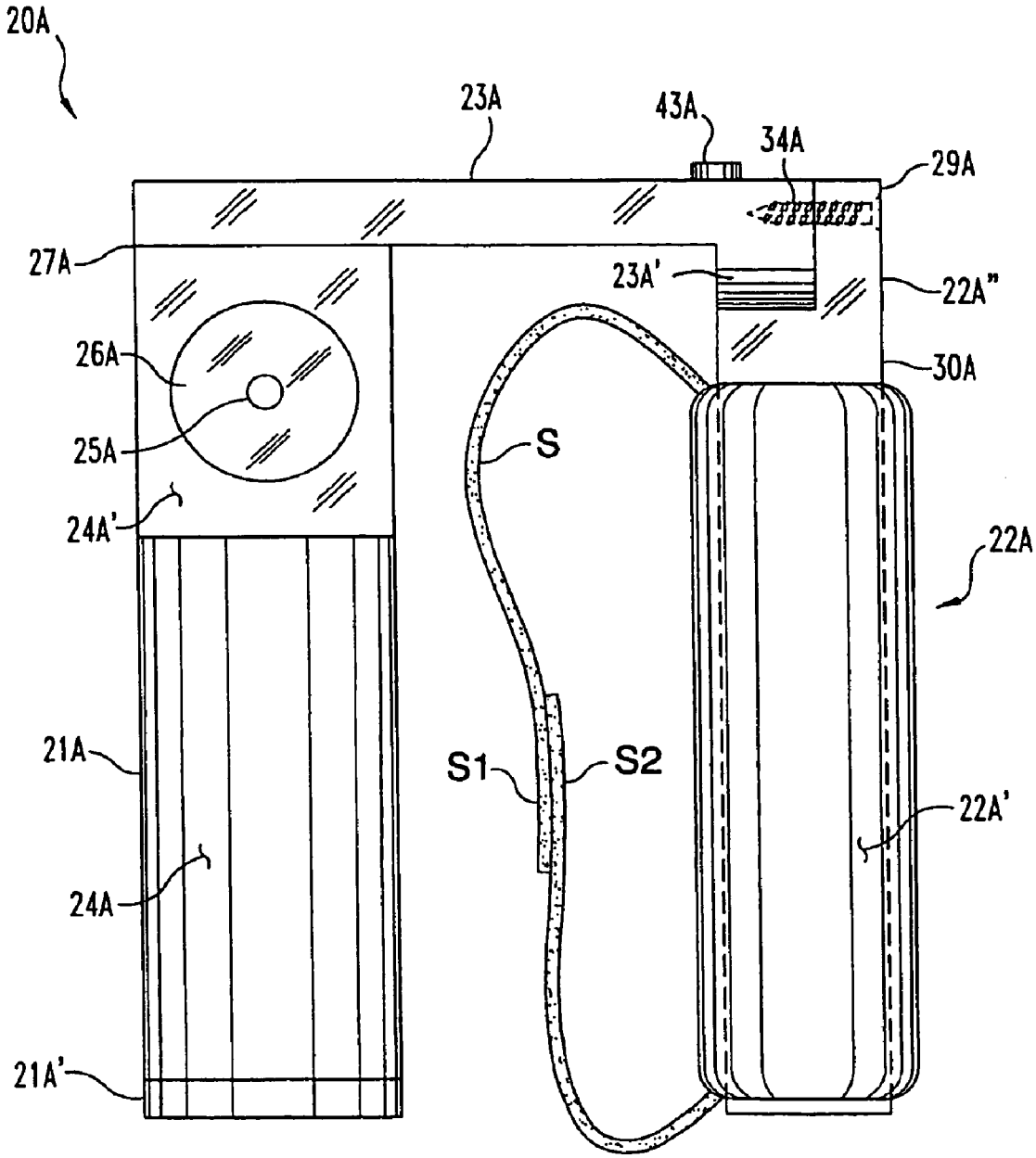
FIGS. 2A–2C provide side and end views of another flashlight device of the invention.
Figure 2B:
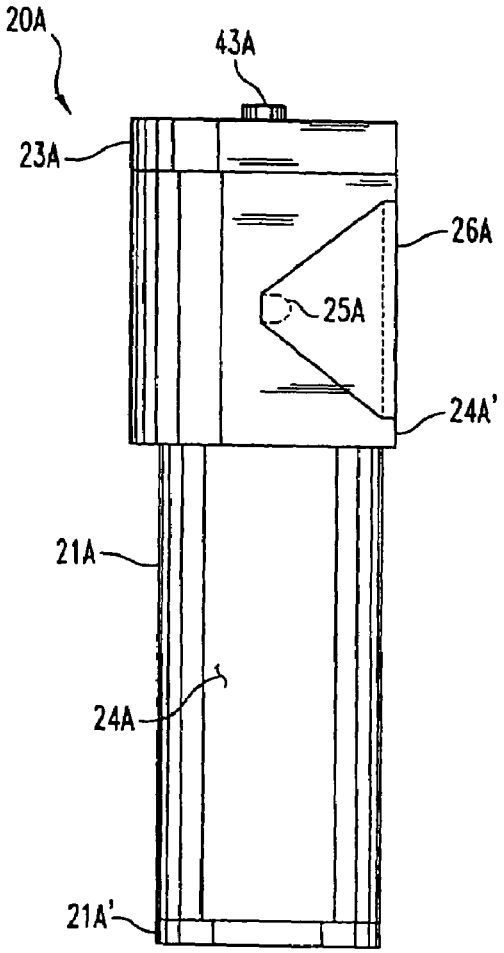
Figure 2C:
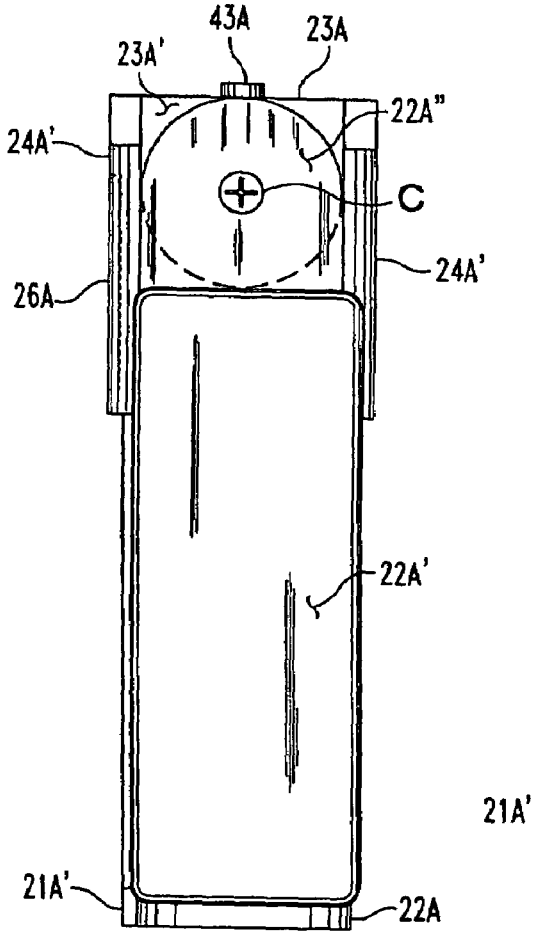

FIGS. 2A–2C illustrate another flashlight embodiment 20A of the invention (2A, front view; 2B, right end view; 2C, left end view). Flashlight 20A is similar in many respects to flashlight 20 of FIG. 1, and has parts correspondingly numbered with the designator "A". Flashlight 20A, however, has a lightbox 21A that includes both a generally cylindrical portion 24A, and a flat front face portion 24A' in which lens 26A and light source 25A are mounted. As shown, face portion 24A' has a generally planar front, which extends into a generally rounded back portion. Flashlight 20A also includes a polymeric sleeve 22A' on its handle portion 22A, as well as a strap "S" through which a user's hand may be placed. Strap S may be a loop of material received under sleeve 22A' as shown, or may be held to flashlight 20A by buckles or in any other suitable fashion. As well, strap S may also have connecting portions S1 and S2 as shown, which allow for adjustment of the size of the strap loop. This connection may be achieved, for example, by suitable hook and loop fasteners attached to and/or formed within the material of the strap S. Flashlight device 20A also incorporates a rotatable connection between handle 22A and transverse member 23A. In the illustrated device, transverse member 23A includes a downwardly depending leg 23A' with a generally "U" shaped external profile, and handle portion 22A includes an upwardly extending leg 22A" with a cooperating, generally inverted "U" shaped external profile (lower periphery shown in phantom in FIG. 2C). These two legs provide opposing plates or faces that contact one another for a rotatable, friction fit. The handle portion 22A is connected to transverse member 23A by a connector 34A such as a screw. The connection can be sufficiently tight to provide for a snug but rotatable relationship between the handle 22A and transverse member 23A. Alternatively or in addition, the connector can be adustable (e.g. as in a screw) so as to enable loosening the fit, adjusting the angle of handle 22A relative to transverse member 23A, and then tightening the fit. Additionally, as discussed hereinabove in connection with FIG. 9, meshing gears, teeth, ridges or other surface features can be provided on the faces of legs 23A' and 22A", to facilitate a locked and/or fixed attachment between the faces.

Figure 2D:
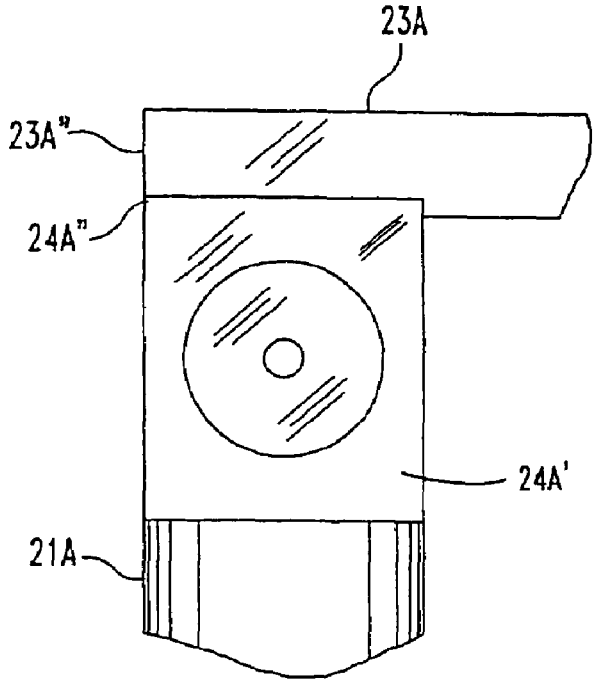
FIGS. 2D and 2E provide a side and left end view of another flashlight device of the invention.
Figure 2E:
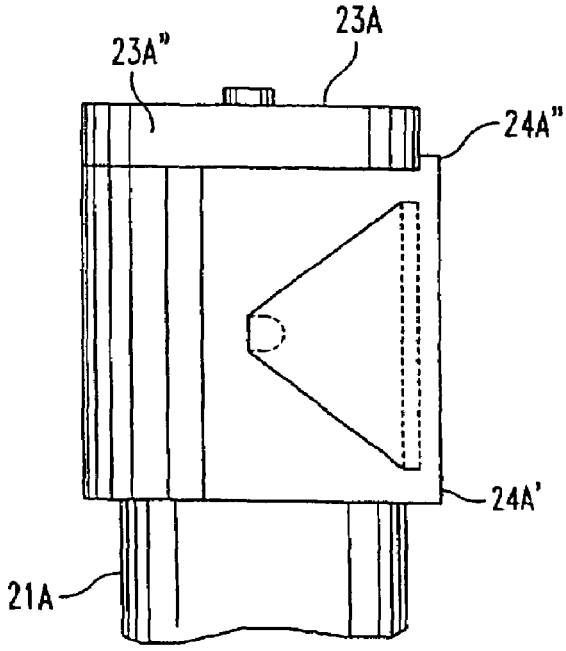

FIGS. 2D and 2E provide cutaway side and left end views corresponding to those of FIGS. 2A and 2B, except the flashlight device has a modified front face in which a lip 24A" or other projection extends upwardly from the face 24A', such that it overlies the front face of transverse member 23A. As well, transverse member 23A has a rounded end 23A". In this manner, the inward rotation of lightbox 21A is restricted by contact between lip 24A" and the front face of transverse member 23A, but lightbox 21A can be freely rotated outwardly, and has about 180 degrees (180°) of rotational freedom, so that the light can be positioned to a forward lighting position as described herein, and a position reversed from that shown in FIGS. 2D and 2E to provide more effective use in either hand.

Figure 4:
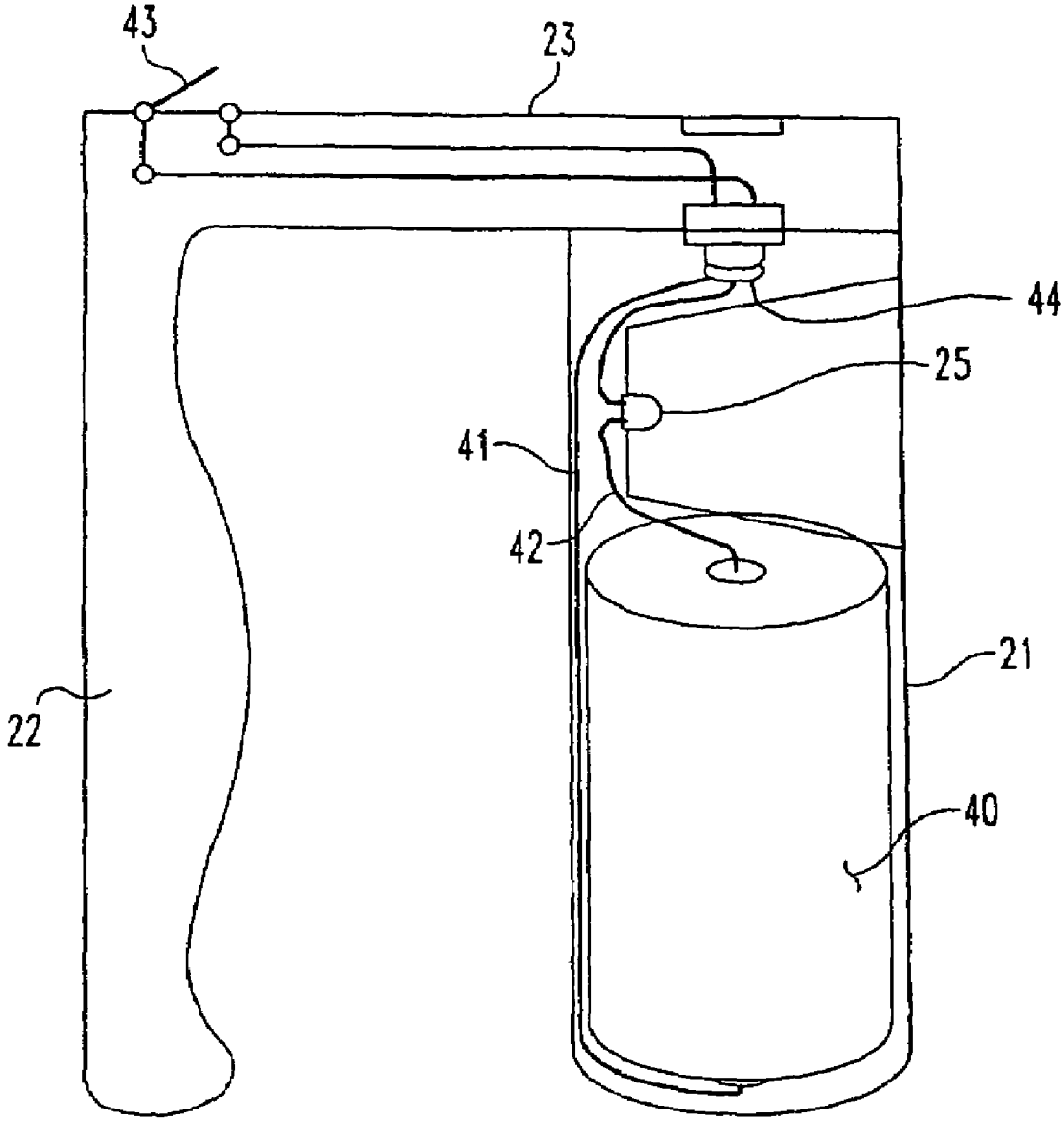
FIG. 4 provides an illustration of internal circuitry of a flashlight device of the invention.

With reference now to FIG. 4 together with FIGS. 1 and 2, provided is a drawing illustrating a potential configuration for the internal electronics of the flashlight device 20,20A. Light source 25,25A is positioned within lightbox 21,21A and is powered by one or more batteries 40 mounted within the lightbox 21,21A. Access to the battery or batteries 40 can be provided, for example, via a threaded cap 21',21A' located at the bottom of lightbox 21,21A. Positive and negative leads 41 and 42 create a circuit in conjunction with light source 25,25A and switch 43,43A. For these purposes, leads are positioned through a central channel 44 extending between lightbox 21,21A and transverse member 23,23A. As shown, switch 43,43A is provided upon transverse member 23,23A, and is spatially located atop or overlying handle portion 22,22A or at a position along transverse member 23,23A between handle portion 22,22A and lightbox 21,21A. For instance, in one embodiment, switch 43,43A can be provided adjacent or in proximity to the outer edge of the transverse member 23,23A overlying the outer edge of handle portion 22,22A, to provide convenient access for operation during a two-handed firing position or other manual hand activites (see e.g. FIGS. 3 and 6). Switch 43,43A can be of any suitable design for energizing and de-energizing the light source 25,25A with the battery or batteries 40. Preferably, switch 43,43A is a pressure-sensitive switch functional to energize the light source 25,25A upon the exertion of pressure, but without locking or fixing the switch in the "on" position. In this fashion, the user of the flashlight can more readily briefly energize, and then de-energize the light source 25,25A to fix the position of an article or person, but without continued illumination. In addition to a "pressure-on" position, such a pressure-sensitive switch may, if desired, have a fixed "on" condition that is achieved upon exerting greater than a predetermined level of pressure on the switch.

Figure 5:
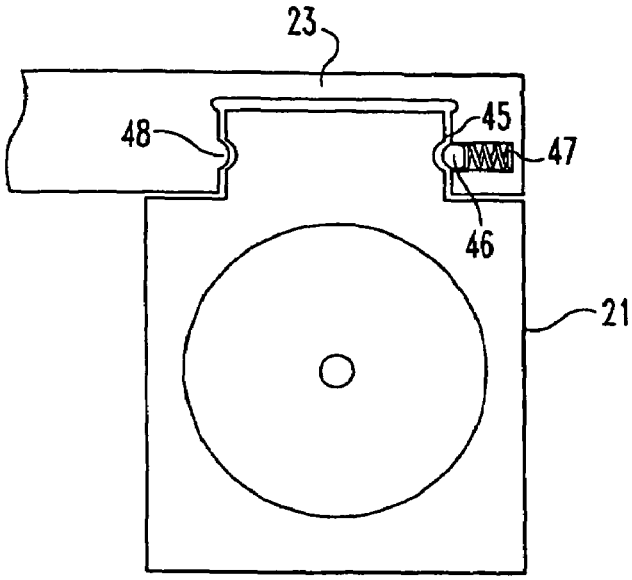
FIGS. 5 and 5A provide cutaway cross-sectional views of potential rotatable connections between transverse members and lightboxes of flashlights of the invention.

With reference now to FIG. 5 in conjunction with FIG. 1, shown is one potential embodiment of the invention for connecting the lightbox 21 to the transverse member 23. In particular, in the illustrated arrangement a number of indexed or predetermined positions are defined between the lightbox 21 and the transverse member 23. For example, cutouts or other depressions 45 may be provided within an outer side surface of the lightbox 21 at its upper end, and a cooperating member 46 such as a ball may be provided on the transverse member 23 for cooperating with depressions 45 located around the circumference of lightbox 21. Cooperating member 46 can for example be biased toward the lightbox 21 with a spring 47 or other biasing device, to provide an appropriate level of resistance to hold lightbox 21 in a position defined by cutouts 45, but which resistance can be overcome with sufficient force to move the lightbox 21 to an alternate indexed position. Additional protuberances 48 can be provided around in the inner surface of the transverse member connection to assist in the indexing function as well.

Figure 5A:
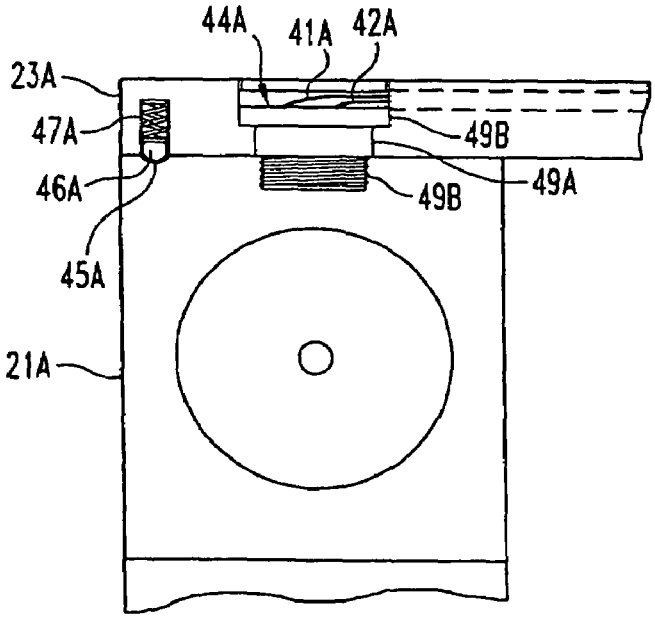

With reference now to FIG. 5A in conjunction with FIGS. 2A–2E, shown is an illustration of another manner of rotatably connecting lightbox 21A to a transverse member 23A. In this embodiment, the ball 46A and spring 47A combination for the detent positions is received within an aperture in the lower surface of transverse member 23A. Cutouts 45A or other indentations for cooperating with the ball 46A are then located upon an upper surface of lightbox 21A. A hollow bushing 49A is received within a shouldered bore in transverse member 23A, and a cooperating threaded member 49B is received through bushing 49A and threaded into a corresponding bore in the upper wall of lightbox 21A. A rotatable connection is thereby provided. As shown, threaded member 49B can be hollow or otherwise include a thru-bore 44A so that wires 41A and 42A can pass through the connection. Wires 41A and 42A can then, if desired, pass through an internal opening or bore within transverse member 23A (FIG. 5A, shown in phantom) for connection to a switch as described hereinabove.

With reference generally to FIGS. 1, 2A–2E, and 5 and 5A, any number of indexing positions for the lightbox 21,21A can be provided. In one embodiment, light box 21,21A will be restricted to 360° of rotation or less, for example 180° of rotation, having multiple defined indexed positions. Restricting rotation of the lightbox 21,21A will assist in preventing undue twisting of leads 41,42,41A,42A in the simple design illustrated, where the leads are fixed or otherwise tend to rotate along with the lightbox 21,21A. Of course, other circuitry or wiring designs could be adopted to address this problem as well, including for example the use of a rotatable electrical connection. For example, use may be made of conductive metallic components such as metal disks or rings that provide electrical contact from the handle and switch to the light box. The two components, one wired to the switch and one connected to the light box, would remain in constant contact with one another. The component wired to the switch would remain fixed while constantly making contact with the other component that would be connected to the light-box. The component wired to the light-box would rotate, for example 180°. Another rotatable electrical design could incorporate a wired, spring-loaded pin which would make contact with a metallic component connected to the light box.

Figure 3A:
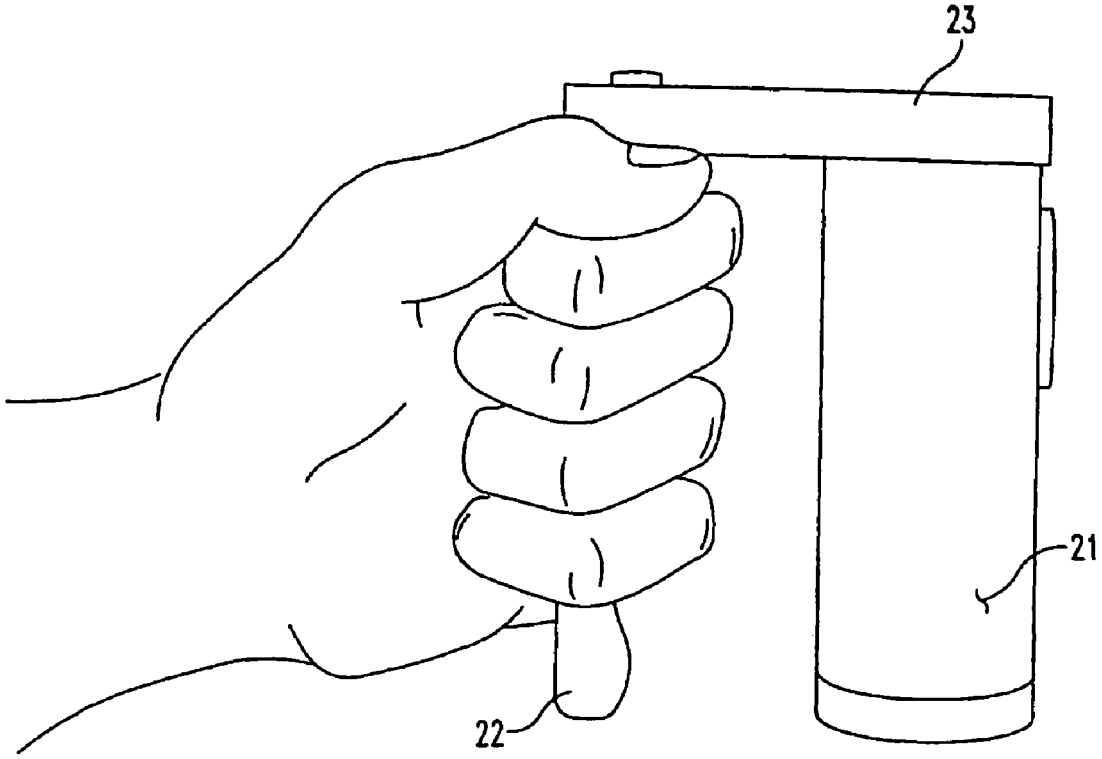
FIG. 3A provides a perspective view of a flashlight device of the invention in a forward lighting position.

In a preferred design, lightbox 21,21A will have indexed positions spaced about 90° from one another. With reference to the orientation of the devices 20,20A as shown in FIGS. 1 and 2, these positions may be defined with the light source 25,25A facing as shown (e.g. as used in a firearm firing position), 90° clockwise therefrom (thus facing directly away from handle 22,22A for "forward lighting" (see FIG. 3A), and 180° clockwise from the illustrated position. This latter position allows the device 20,20A to be similarly used in either the left or right hand during firing or other manual activities. In this regard, in addition to or as an alternative to indexed positions wherein light source 25,25A is directed at a 90° angle relative to the axis of transverse member 23,23A, indexed positions may be provided angled slightly inwardly from 90° (see e.g. FIG. 6) so that the light beam from light source 25,25A will be more directly aimed at a target during a firing position. The angle in this situation will vary depending upon the anticipated target distance, and upon the useful range of the light source 25,25A.

Figure 10:
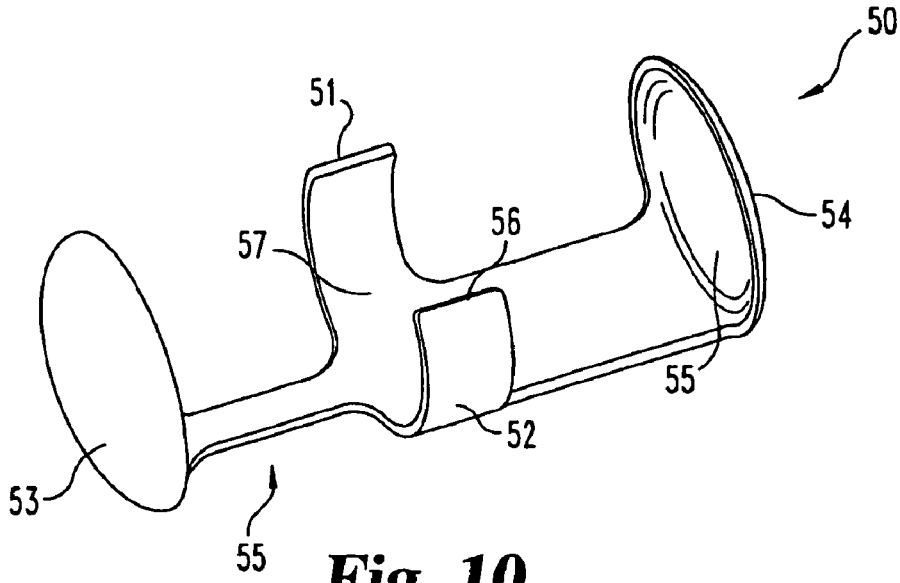
FIG. 10 provides a perspective view of a flashlight holster device of the invention.
Figure 11:
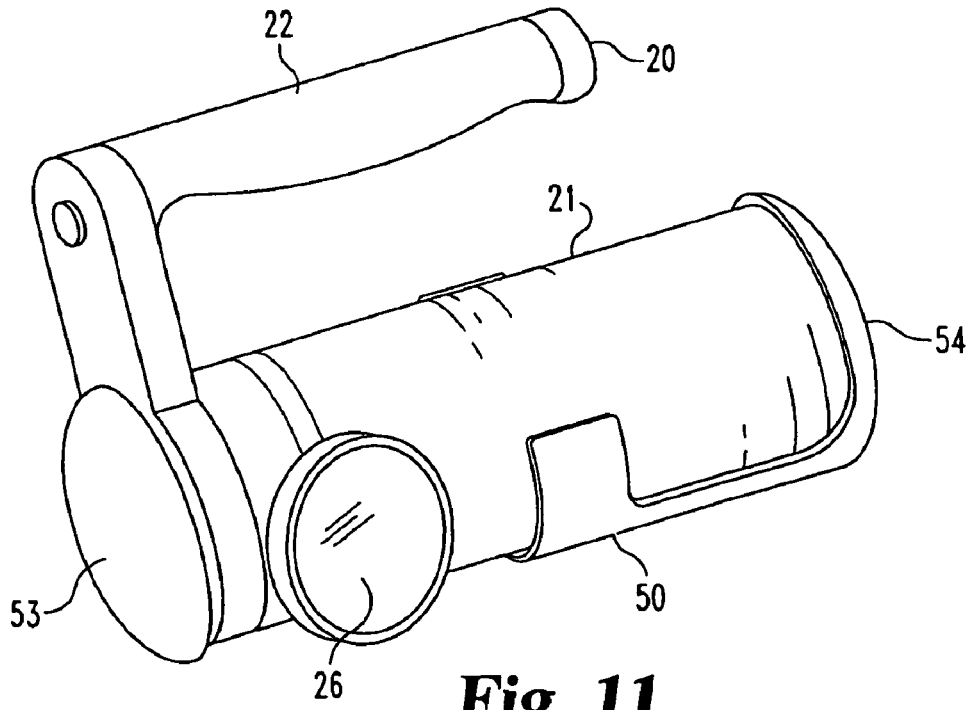
FIG. 11 provides a perspective view of the holster device of FIG. 10 having a flashlight mounted therein.
Figure 12:
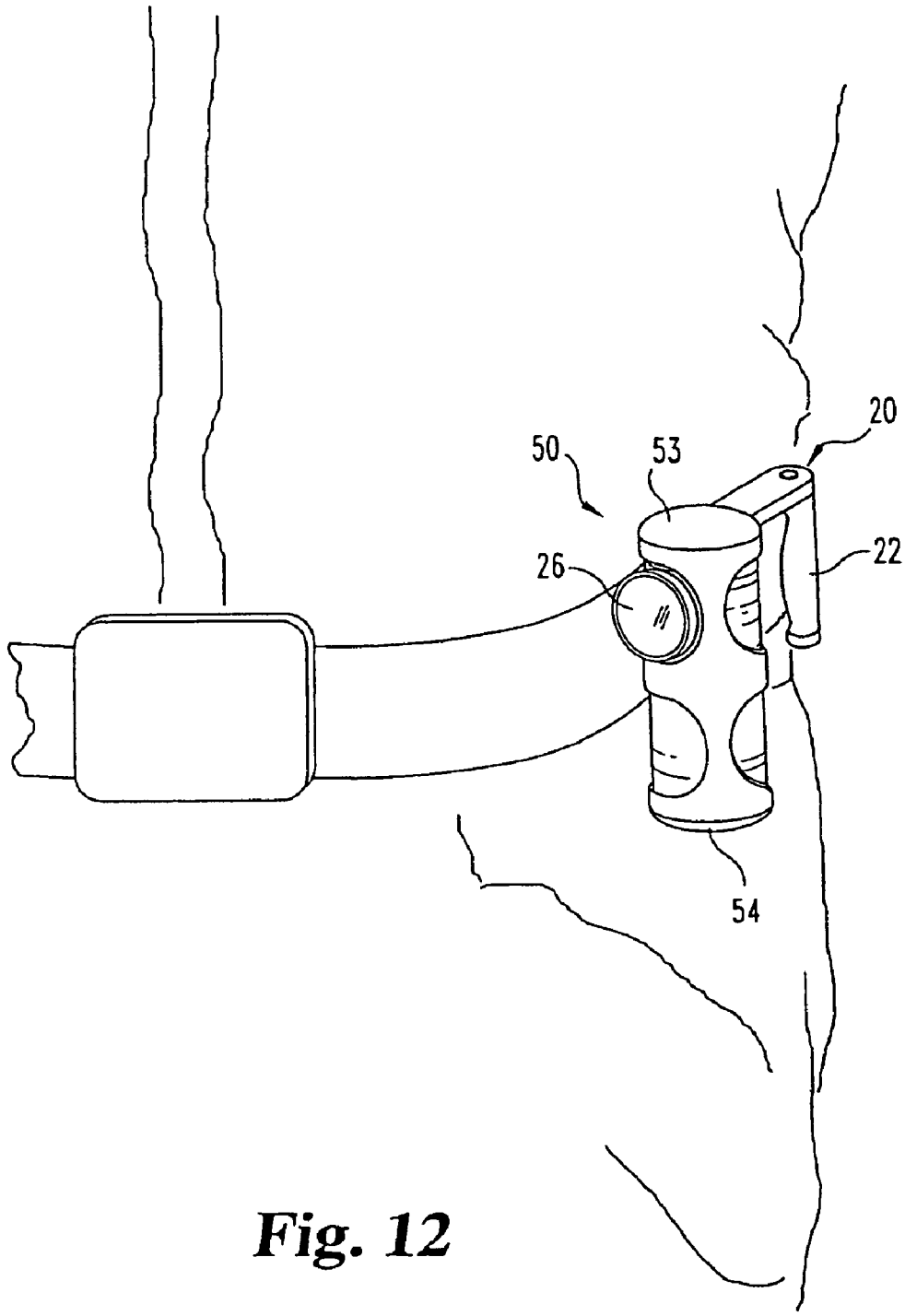
FIG. 12 provides a perspective view a flashlight/holster combination of the invention in use.

With reference now to FIGS. 10–12 in connection with FIGS. 1 and 2, illustrated is a holster 50 for use in connection with a flashlight 20,20A of the invention. Holster 50 generally includes a member 51 for connection to the belt of a user, for example by clipping on the belt or having the belt string through the member 51. Holster 50 also generally includes a receiving portion 52 for receiving the lightbox 21,21A of the flashlight device 20,20A. In particular, preferred holster device 50 includes a first end 53 and a second end 54, which serve to cover the upper and lower surfaces of the lightbox 21,21A and help an alignment of the flashlight 20,20A during a holstering function. Receiving portion 52 includes at least one cutout portion, and preferably a plurality of cutout portions along the body providing openings 55 for receiving the light source 25,25A and lens 26,26A of the lightbox 21,21A, so that the flashlight 20,20A may be used to provide illumination even when holstered (see e.g. FIGS. 11 and 12). Preferably, holster device 50 will include at least one member 56 located between ends 53 and 54 extending sufficiently up and potentially around lightbox 21,21A to retain flashlight 20,20A in holster 50 by gravitational force and/or by friction or snap fit.

With reference now particularly to FIG. 12, illustrated is the flashlight device 20,20A contained within the holster 50, with lens 26,26A of flashlight 20,20A exposed for illumination in a forward direction. Holster 50 is secured to the side of a user 100, for example by attachment to a belt as discussed above. As shown in FIG. 12, the holster 50 has been rotated to a vertical orientation. This is provided in the preferred holster device by incorporating a swivel or other moveable attachment between attachment member 51 and the receiving portion 52 of the holster device 50. Such a swivel function may for example be provided by rotateable pin connector 57 connecting attachment member 51 and receiving portion 52 of holster device 50 as can also been seen in FIGS. 11 and 12, when flashlight device 20,20A is received within holster 50, handle portion 22,22A is located external of receiving portion 52 of holster 50 and thereby readily available to grasp. In addition, the illustrated position can provide for "hands-free" forward illumination when the flashlight 20,20A includes a fixed "on" switch position.

Housing components of devices of the invention are preferably made from metal or an impact-resistant plastic, such as ABS. In addition, flashlights of the invention are desirably constructed to be waterproof, for example incorporating O-rings between moving parts, and plastic parts are preferably made fire retardant either in their composition, or with a suitable fire retardant coating. Flashlights of the invention also desirably incorporate attachable or attached red lenses to cover the light source 25,25A. Such red lenses facilitate dimming the light source, and in combat or defense situations make it more difficult for a target to discern people or things behind the light source.

Figure 13:
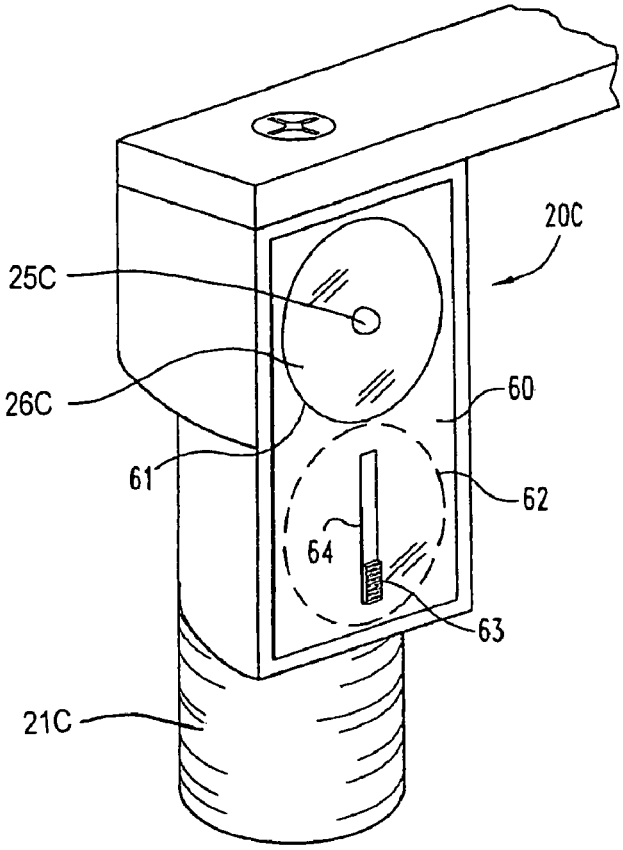
FIG. 13 provides a cutaway perspective view illustrating a lightbox of another flashlight of the invention, including a slidable red lens.

With reference now to FIGS. 13 through 19, a number of illustrative red lens appliances useful in conjunction with flashlights 20 and 20A, or modified versions thereof, are shown. Shown in FIG. 13 is a partial cutaway view of such a flashlight 20C, including a lightbox 21C with an extended, front flat panel incorporating a slidable red lens that can be selectively positioned over the primary clear lens 26C. In particular, an external panel 60 fixed to the lightbox 21C defines an internal cavity and has a cutout 61 sufficient to expose lens 26C. A red lens 62 (shown in phantom) is slidably received within the defined cavity, and has an attached manual slider member 63 protruding through a slot 64 in the panel. In this fashion, a user can manually (e.g. with a finger) slide the red lens 62 overtop of and off of the light source 25C as desired in a particular situation. The position of the red lens 62 within the cavity can be maintained for example by a relatively light friction fit within the cavity, or by other mechanisms by which elements of or attached to the lens 62 cooperate with surrounding surfaces. Additionally, red lens 62 can be sized to have dimensions larger than those of cutout 61 so that lens 62 does not escape or get caught up in cutout 61. Internal channels may also be provided within the defined cavity, in which the outer edges of lens 62 travel. As well, instead of cutout 61, panel 60 may include a transparent lens mounted therein to serve in addition to or as an alternative to any other transparent lens of the flashlight 20C.

Figure 14:
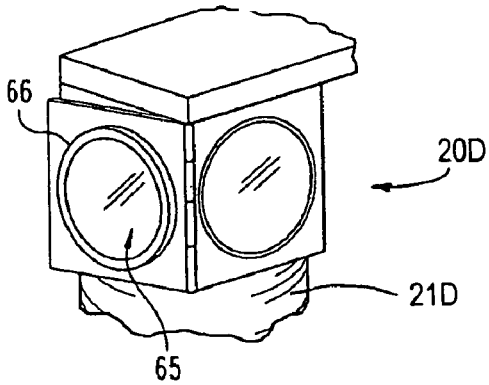
FIG. 14 provides a cutaway perspective view illustrating a lightbox of another flashlight of the invention including a hinged red lens.

FIG. 14 provides a cutaway perspective view of another flashlight embodiment 20D of the invention including a red lens 65 received within a frame 66 hinged to the lightbox 21D.

Figure 15:
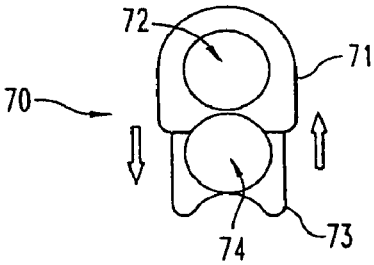
FIG. 15 provides a perspective view of a red lens appliance of the invention.

FIG. 15 provides an appliance 70 in which a red lens is incorporated in a slidable fashion. Appliance 70 includes a first member 71 having a slot therein and an opening 72, and a second member 73 slidably received in the slot. Second member 73 includes a red lens 74, wherein sliding second member 73 into first member 71 exposes the red lens 74 in the opening 72. An appliance such as appliance 70 can be built into, fixedly attached or removably attached (e.g. using a clinging mechanism similar to that shown in FIGS. 16–18 below) to a flashlight device such as 20 or 20A (FIGS. 1 and 2) with the opening 72 positioned over lens 26 or 26A. Selective use of the red lens 74 is thereby enabled.

Figure 17:
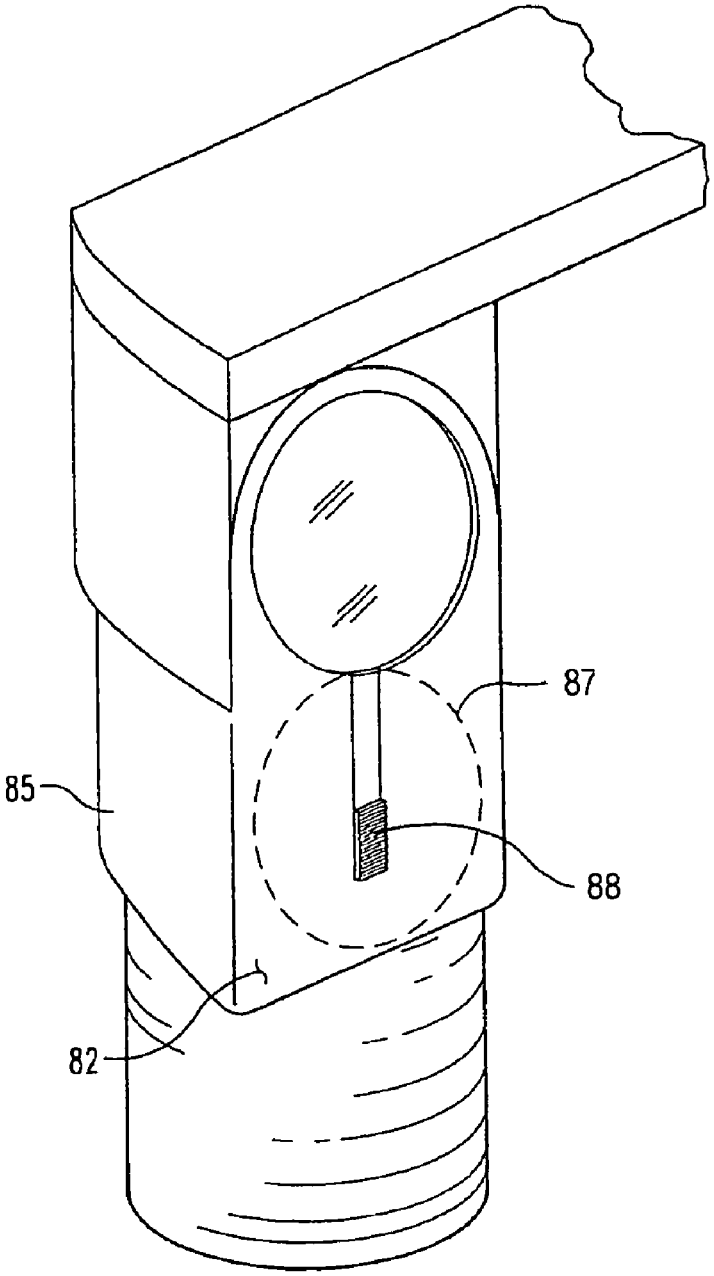
FIG. 17 provides a front perspective view of the appliance of FIG. 16 connected to a flashlight lightbox.
Figure 16:
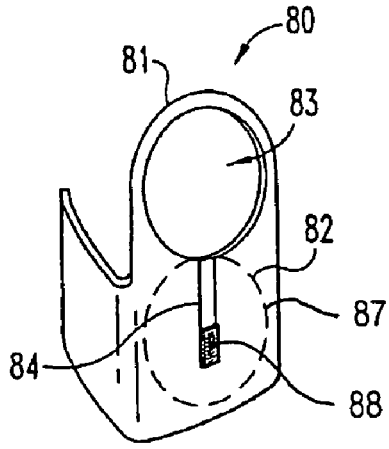
FIG. 16 provides a perspective view of another red lens appliance of the invention.
Figure 18:
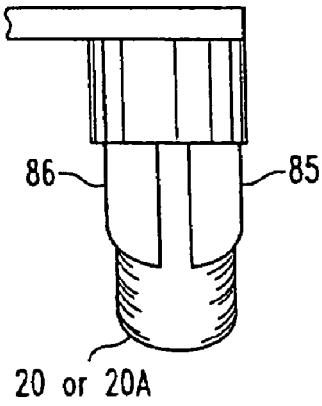
FIG. 18 provides a back perspective view of the appliance of FIG. 16 connected to a flashlight lightbox.

FIGS. 16–18 illustrate another red lens appliance 80 of and for use in the invention. Appliance 80 has a body 81 including a double-walled front panel 82. Panel 82 defines a slot between its two walls for slidably receiving a red lens 87 (shown partially in phantom). Panel 82 also defines a lens opening 83 and an elongate slot 84. A manual slider member 88 attached to the red lens 87 is exposed through the elongate slot 84, for manual operation to selectively position the red lens into and out of the lens opening 83. Body 81 also includes deformable members 85 and 86 which can be deformed so as to provide a mechanical fit such as a snap or friction fit around a cylindrical or other correspondingly configured portion of a lightbox such as 20 or 20A (see also FIGS. 1 and 2). In this fashion a user can both selectively connect and disconnect the appliance 80 with the flashlight, and selectively use or not use the red lens 87 when the appliance 80 is connected.

Figure 19:
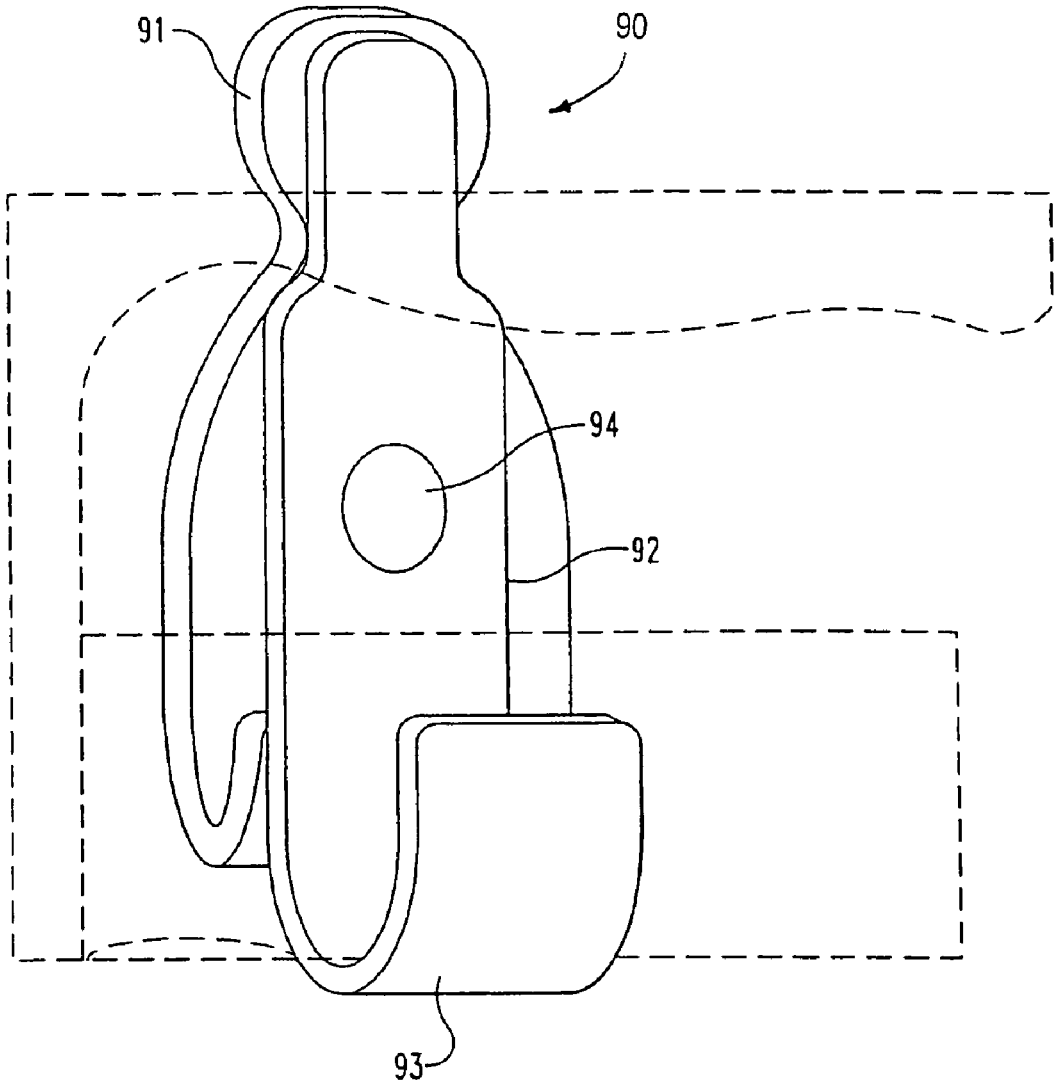
FIG. 19 provides a perspective view of another flashlight holster of the invention.

With reference to FIG. 19, shown is another holster appliance 90 of and for use in the present invention. Appliance 90 includes a clip portion 91 for attachment to a belt or other similar structure of a user, that is attached to a body 92 adapted for providing a mechanical fit such as a snap or friction fit around a cylindrical or other correspondingly configured portion of a lightbox such as 20,20A (see also FIGS. 1 and 2) Body 92 thus can include at least one deformable member 93 configured to fit around and cling to a lightbox such as 20,20A. Desirably, body 92 can be designed so as not to cover or block the lens and light source of such lightboxes, so that the flashlight can be effectively used for illumination while worn attached to the belt of a user. As well, the attachment of body 92 to clip portion 91 can be via a rotatable connection, such as at 94, so as to provide flexibility in use.

Figure 20:
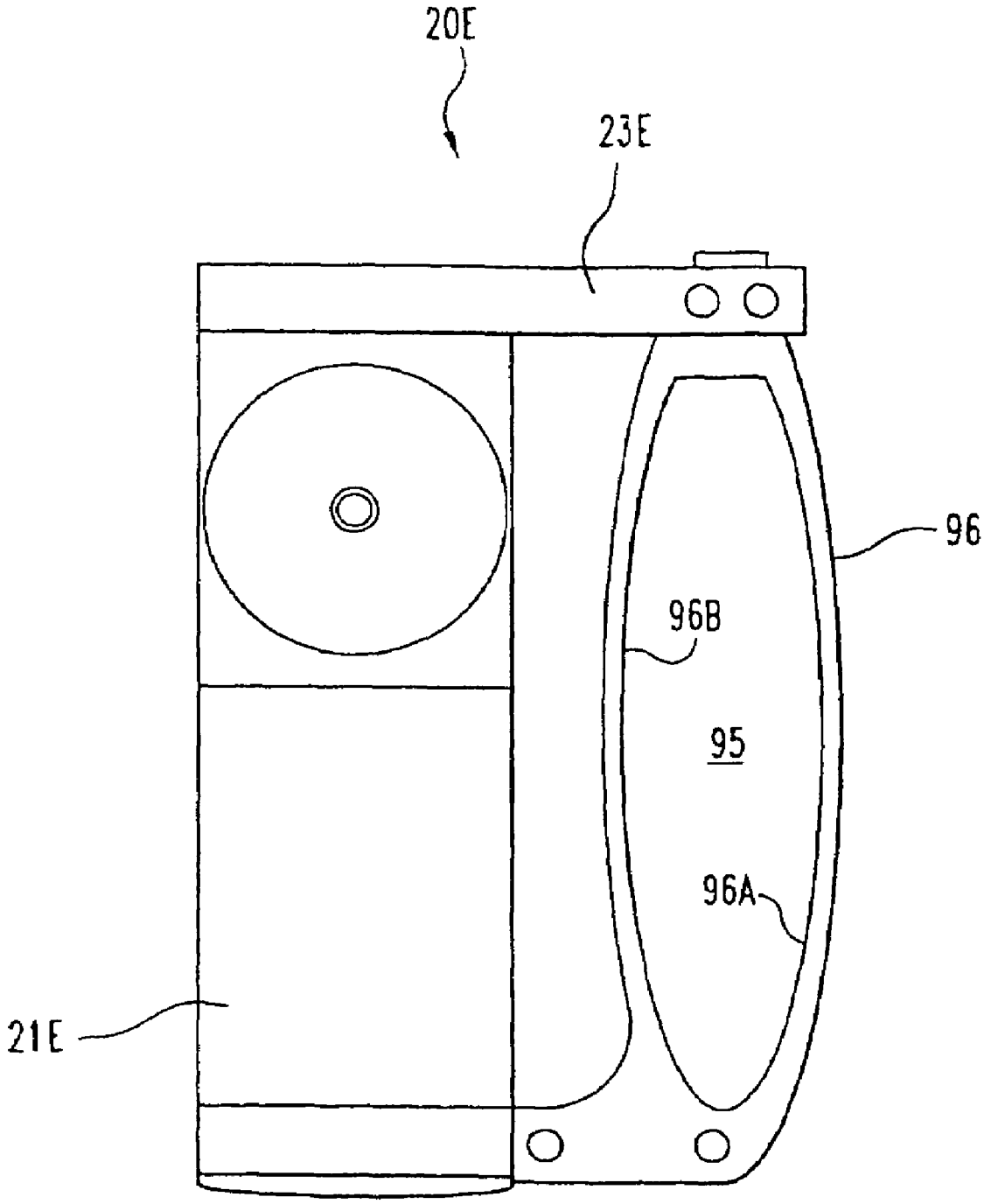
FIG. 20 provides a front view of another flashlight of the invention including a strap assembly handle.

With reference to FIG. 20, illustrated is another flashlight 20E of the present invention. Flashlight 20E can include features generally corresponding to those of the lightboxes and transverse members described for other embodiments hereinabove. However, a different type of handle is provided. In particular, the handle is provided by a strap assembly 96 including first and second strap members 96A and 96B forming an enclosed loop 95 to receive a user's hand. Strap assembly 96 is connected at its upper end to the transverse member 23E and at its lower end to the lower portion of the lightbox 21E. The connection to lightbox 21E is such that the lightbox 21E still can rotate. This may be achieved, for example, by incorporating a ring into the structure of lightbox 21E that is rotatable relative to the remainder of the lightbox 21E, (for example a ring captured within a groove defined between a battery cap and a shoulder of the lightbox housing), or by providing a ring received around lightbox 21E to which the strap assembly 96 is attached.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

What is claimed is:

1. A flashlight comprising:

a handle portion having a longitudinal axis;

a first member having a first end, a second end and a longitudinal axis, said first end connected to said handle portion; and a lightbox connected to said second end, said lightbox having a light source for emitting a directional light beam, said light source is swivelable normal to said first member longitudinal axis to direct the directional light beam in various directions relative to said first member, wherein said handle portion longitudinal axis and a longitudinal axis of said lightbox are substantially parallel with one another and define a hand receiving opening therebetween, said hand receiving opening for receiving a portion of a user's hand, and when said first member longitudinal axis is substantially horizontal, said handle portion longitudinal axis and said lightbox longitudinal axis extend vertically downward.

2. The flashlight of claim 1, wherein said handle portion is pivotable in a plane substantially transverse to said first member.

3. The flashlight of claim 2, wherein said lightbox is rotatable relative to said first member, said lightbox having a longitudinal axis and being rotatable about said axis.

4. A flashlight, comprising:

a handle portion;

a first member connected to said handle portion; and a lightbox connected to said first member, said lightbox having a battery receiving portion and a light source oriented to emit a light beam in a direction substantially transverse to a longitudinal axis of said battery receiving portion, wherein said handle portion, said first member and said lightbox form a substantially inverted U-shaped configuration defining a hand receiving opening adapted to receive a portion of a user's hand, wherein at least one of said lightbox and said handle portion is movable relative to said first member.

5. The flashlight of claim 4, wherein both said lightbox and said handle portion are movable relative to said first member.

6. The flashlight of claim 4, wherein said lightbox is rotatable to indexed positions relative to said first member.

7. The flashlight of claim 4, wherein said handle portion is pivotable to fixed positions relative to said first member.

8. A flashlight apparatus comprising:

a lightbox having a battery receiving portion and a light source, said light source for emitting a directional light beam, said battery receiving portion having a longitudinal axis;

a handle member spatially separated from said lightbox and a longitudinal axis of said handle member being substantially parallel with said longitudinal axis of said battery receiving portion;

a first member having first and second ends, said first end connected to said handle member and said second end connected to said lightbox; and said light source being directionally adjustable relative to said handle member such that when said handle member is stationary and said handle member longitudinal axis is in a substantially vertical orientation, said light source is directionally adjustable through 90 degrees of rotation in a horizontal plane.

9. The flashlight apparatus of claim 8, wherein said light source is directionally adjustable through 180 degrees of rotation.

10. The flashlight apparatus of claim 8, wherein said light source is directionally adjustable through 360 degrees of rotation.

11. A flashlight apparatus comprising:

an assembly including a light-emitting portion for emitting a directional light beam, a handle portion having a handle longitudinal centerline and a first member having a first longitudinal centerline, said first and said handle longitudinal centerlines being substantially perpendicular to each other, said light-emitting portion connected to said handle portion via said first member, said light-emitting portion is movable relative to said handle portion;

said assembly having a first position in which said first longitudinal centerline of said first member and said handle longitudinal centerline of said handle portion define a first plane and the directional light beam of said light-emitting portion is substantially parallel with said first plane and said first longitudinal centerline of said first member during use; and said assembly having a second position with said first longitudinal centerline of said first member and said handle longitudinal centerline of said handle portion in said first plane and the directional light beam of said light-emitting portion is substantially transverse of said first plane and said first longitudinal centerline of said first member during use.

12. The flashlight apparatus of claim 11, further comprising a switch positioned on said first member.

13. The flashlight apparatus of claim 11, wherein said handle portion is pivotably connected to said first member.

14. The flashlight apparatus of claim 13, wherein said light-emitting portion is rotatably connected to said first member.

15. The flashlight apparatus of claim 11, further comprising a hand strap attached to said assembly, said hand strap adapted to secure said assembly to a person's hand.

16. A flashlight apparatus comprising:

an assembly including a lightbox interconnected to a handle portion having a longitudinal centerline, said lightbox comprising a battery receiving portion having a longitudinal axis and a light-emitting portion for emitting a directional light beam during use, said light-emitting portion is movable relative to said handle portion;

said assembly having a first position in which said longitudinal axis of said battery receiving portion and said longitudinal centerline of said handle portion define a first plane and the directional light beam of said light-emitting portion is substantially parallel with said first plane during use; and said assembly having a second position with said longitudinal axis of said battery receiving portion and said longitudinal centerline of said handle portion in said first plane and the directional light beam of said light-emitting portion is substantially transverse to said first plane during use.

17. The flashlight apparatus of claim 16, further comprising:

a first member having a longitudinal centerline, said lightbox connected to said first member and said handle portion pivotably connected to said first member; and said assembly having a third position in which said longitudinal axis of said battery receiving portion and said longitudinal centerline of said first member define a second plane and said longitudinal centerline of said handle portion is non-coplanar with said second plane.

18. The flashlight apparatus of claim 17, wherein said lightbox is rotatably connected to said first member.

* * * * *